United States Patent [19]

Schwab

[11] Patent Number: 4,792,664

[45] Date of Patent: Dec. 20, 1988

[54] CLOSURE COUNTER

[75] Inventor: Walter Schwab, Gröbenzell, Fed. Rep. of Germany

[73] Assignee: Chibret Pharmazeutische GmbH, Munich, Fed. Rep. of Germany

[21] Appl. No.: 946,263

[22] Filed: Dec. 24, 1986

[30] Foreign Application Priority Data

Jan. 24, 1986 [DE] Fed. Rep. of Germany ..... 3602119

[51] Int. Cl.[4] ..... B65D 55/12; G06M 1/02

[52] U.S. Cl. ..... 235/103; 116/307; 206/534; 215/230

[58] Field of Search ..... 235/103; 116/307–312; 206/534; 215/219, 220, 211, 218, 230, 359

[56] References Cited

U.S. PATENT DOCUMENTS

| | | | |
|---|---|---|---|
| 3,279,651 | 10/1966 | Thompson | 221/88 |
| 4,011,829 | 3/1977 | Wachsmann et al. | 206/534 X |
| 4,220,247 | 9/1980 | Kramer | 215/219 |
| 4,223,801 | 9/1980 | Carlson | 221/3 |
| 4,245,742 | 1/1981 | Rossmo | 206/534 |
| 4,365,722 | 12/1982 | Kramer | 215/220 |
| 4,528,933 | 7/1985 | Allen | 116/312 X |
| 4,562,933 | 1/1986 | Dennis | 116/308 X |
| 4,705,182 | 11/1987 | Newel-Lewis | 215/230 |

FOREIGN PATENT DOCUMENTS

| | | |
|---|---|---|
| 1235363 | 6/1971 | United Kingdom . |
| 2116153 | 9/1987 | United Kingdom . |

*Primary Examiner*—Benjamin R. Fuller

*Attorney, Agent, or Firm*—Edward W. Murray; William H. Nicholson

[57] ABSTRACT

A closure counter for counting how many times a screw cap closure has been closed and opened is described, which is back in its initial position after N closing and opening operations.

The closure counter includes an open-bottomed housing (10) and a likewise open-bottomed cap-shaped counting unit (11) arranged in the housing for rotation about its longitudinal axis (12), the rotary motion relative to the housing (10) is limited to a fraction 1/N of one full rotation, and a display unit (13) is arranged for rotation about the longitudinal axis (12) of the counting unit (11), the rotation of the display unit (13) relative to the counting unit (11) being allowed in only one direction by a ratchet (14), the click motion likewise corresponds to the fraction 1/N of one full rotation, and there is sliding fit between the housing (10) and the display unit (13).

5 Claims, 5 Drawing Sheets

CLOSURE COUNTER

BACKGROUND OF THE INVENTION

The invention relates to a closure counter for counting how many times a screw cap closure has been closed and opened, said closure counter being back in its initial position after N closing and opening operations.

Most medicines must be administered in a predetermined dosage one or two times per day. Frequently it is difficult for the patients to follow the instructions concerning the dosage because after a few hours already they cannot remember whether or not they have taken the medicine. In order to permit checking of the administration pills, for example, are packaged in blister packages and the weekday or day of the month is printed beside each pill. However, this type of packaging is not possible with fluid medicines, e.g. eyedrops, and generally with medicines stored in containers with screw cap closures.

Also in chemical and pharmaceutical laboratories, where reagents must be added at predetermined time intervals, it is suitable to have a counting screw cap. This obviates a written record on each individual addition of reagent.

SUMMARY OF THE INVENTION

It is the object of the invention to provide a closure counter, i.e. a counter integrated in or directly connected to the screw cap closure and counting how many times the screw cap closure has been opened or closed. The closure counter is to require no additional manipulation, i.e. the closure counter is to be actuated automatically when the closure cap is opened and closed.

This object is realized in that the closure counter has an open-bottomed housing and a likewise open-bottomed cap-shaped counting unit arranged in the housing and rotatable about its longitudinal axis, said rotary motion being limited to a fraction 1/N of a full rotation, and a display unit arranged for rotation about the longitudinal axis of the counting unit, said rotation of the display unit relative to the counting unit being allowed by a ratchet in only one direction, the click motion likewise being the fraction 1/N of a full rotation, and there is sliding fit between the housing and the display unit.

The housing, the counting unit and the display unit are suitably of cylindrical configuration, and the display unit is provided on the upper end of the counting unit having lesser external diameter, so that the display unit and the counting unit have substantially equal external diameters. The external diameter of the display unit is somewhat wider, since there is sliding fit between the display unit and the inner side of the housing, while the counting unit can rotate within the housing with more clearance.

The counting unit can rotate within the housing through only a limited angle which is equal to the Nth fraction of a full rotation. This limitation can be attained by a pin projecting from the inner housing wall and engaging a groove in the outer side of the counting unit; said pin can also be formed on the outside of the counting unit and said groove in the inside of the housing. It is also possible to provide at the lower rim of the housing inside projections engaging the lower rim of the counting unit. Between the projections and the recesses there is a clearance in peripheral direction which corresponds to the Nth part of a full rotation. Owing to said relatively wide clearance there are generally provided only two or three recesses and projections.

The display unit is connected to the counting unit by way of a ratchet so that, upon rotation in one direction, the counting unit carries the display unit along, while upon rotation in the opposite direction the display unit is not carried along, i.e. it does not co-rotate. For this purpose preferably sawtooth-like teeth jut out at about half the height of the display unit, and at the lower rim of the display unit one or more pawls are provided. The click motion, i.e. the spacing of the teeth, likewise corresponds to the Nth part of the circle periphery, so that altogether N teeth are provided. Locking can be effected either upon right-hand or left-hand rotation. Depending on the locking direction, the display unit is rotated through the Nth part of a full rotation relative to the housing either upon opening or closing of the screw cap closure.

The teeth can be provided also at the display unit and the pawl at the counting unit. It is merely essential that the display unit and the counting unit cooperate like a ratchet, i.e. that upon rotation in one direction they are locked together, while in the other direction they are free.

The sliding fit can be tightened by the insertion of a small spring along a secant at the head portion of the display unit so that the spring slightly extends beyond the cylinder periphery.

The counting unit is cap-shaped so that it is hollow inside. The cavity can be formed such that it fits onto the screw cap closure of a container and is positively or non-positively engaged therewith. The counting unit itself can form the screw cap closure, and to this end it can be provided with threads or other closing means on the cavity interior.

The closure counter operates as follows: To open the closure, the housing is turned counterclockwise relative to the container, as usual. Owing to the sliding fit, the housing carries the display unit along, while the counting unit is carried along only after one Nth rotation. The ratchet is to be so designed that in counterclockweise direction the display unit is freely movable relative to the counting unit. As soon as the counting unit is carried along upon rotation of the housing, the cap of the screw closure is opened in the usual way. Since the display unit does not rotate relative to the housing, the display remains unchanged. The display consists of N indicia of equal angular width on the outside of the display unit, one at a time being visible through a window in the cylinder wall of the housing which is in register therewith. Also the fixedly positioned top of the housing may be provided with a window. In that case one section each in the top area of the display unit becomes visible.

When the container is closed, the closure counter is placed in the usual way on the container opening and is turned clockwise. Again, the housing carries along the counting unit only after one Nth rotation. Since in clockwise direction the rotation of the display unit relative to the counting unit is locked, also the display unit is carried along only after one Nth rotation, i.e. in the window of the housing the next indicium area appears. The housing is then rotated further in clockwise direction until the the container is closed. If the torque of the sliding fit is higher than that of the screw cap closure, the display unit and the counting unit are first carried along by the rotation of the housing, and the display unit takes one step forward only at the end of the closing operation.

If the rotation of the display unit is locked in opposite direction, the display area moves forward as the screw cap closure is opened, rather than closed.

If a medicine must be taken daily, it is suitable to select N=7, and the display areas can bear abbreviations for the weekdays. If a medicine must be taken twice a day, N=14 is selected, and suitably the display areas have alternatingly differing colors and, in addition, bear abbreviations for the weekdays. Of course, the display areas can also be numbered consecutively, e.g. for medicine to be taken each hour.

It is an advantage of the screw cap closure that counting can begin with any desired display area. The display areas can be switched by turning the housing back and forth relative to the counting unit.

Hereafter an example of the invention will be explained with reference to the drawing wherein FIG. 1 shows a section through the housing along the length axis;

Figure 1:
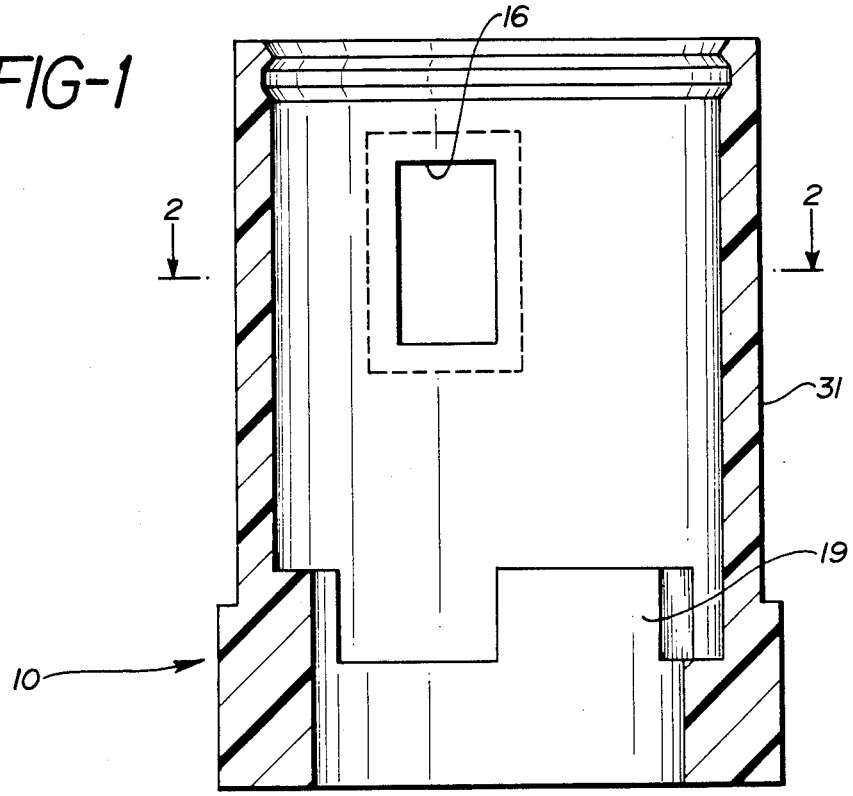
Figure 2:
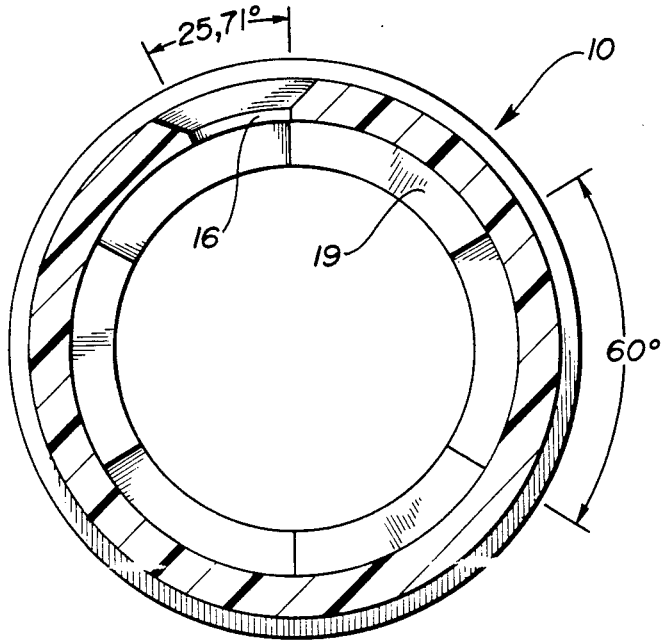
FIG. 2 shows the housing in section along the line 2—2 in FIG. 1.

As shown in FIGS. 1 and 2, the housing 10 is, on the whole, of cylindrical shape and is open at the bottom, while on top it is closed by a cover 30. In the illustrated embodiment the cover 30 is detachable for assembly purposes. However, the cover 30 can also be integral with the cylinder wall 31. At the lower end of the inside of the cylinder wall 31 three projections 19 are provided which resemble merlons extending each around 60° of the circle circumference and spaced apart an equal angular width. For reasons of stability the lower rim of the cylinder wall 31 is thickened somewhat in outward and inward direction. The inwardly facing thickened portion corresponds to the thickness of the projections 19.

Figure 3:
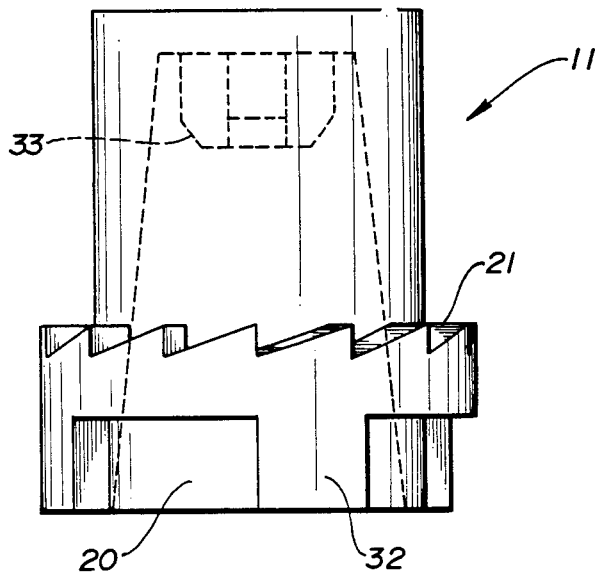
FIG. 3 shows a lateral view of the counting unit.
Figure 4:
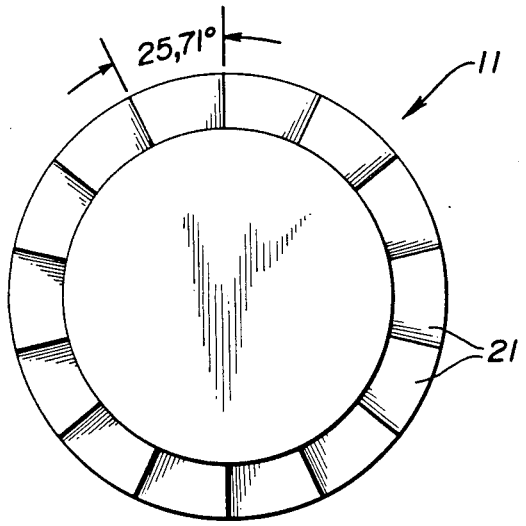
FIG. 4 shows a plan of the counting unit.
Figure 5:
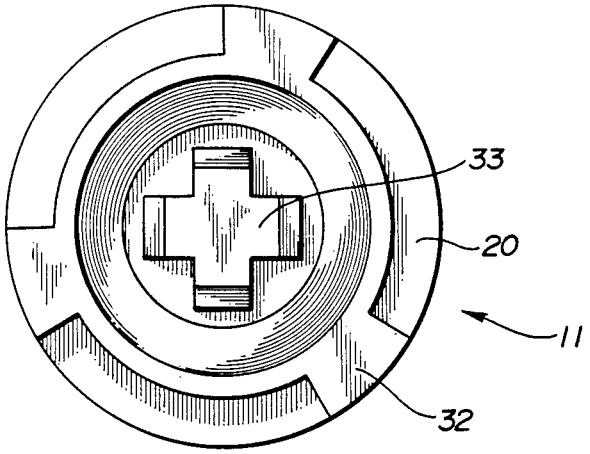
FIG. 5 shows a bottom view of the counting unit.

FIGS. 3, 4 and 5 show the counting unit 11. It has the shape of a cap, i.e. an open-bottomed cylinder. The cylindrical outer surface widens downwardly in a step at about ⅓ of its height, said enlargement being required to accommodate teeth 21 of a ratchet 14. Below the teeth 21 there are three niche-like recesses 20 extending each over an angle of about 90° leaving ribs 32 of an angular width of about 30°. The niche-like recesses 20 in the assembled closure counter engage, in the manner of a denture clutch, the projections 19 on the housing inside 10 permitting one 14th rotation (rotation through 25.71°) between the housing 10 and the counting unit 11. The teeth 21 have sawtooth shape.

FIG. 4 shows the counting unit from top with the tooth tips visible.

FIG. 5 shows the counting unit from the bottom. The hollow inside of the counting unit 11 is designed so that it can grip a frustoconical closure cap having a crater-shaped depression at the blunt top. For frictional engagement the hollow inside has a cruciform projection 33 at the upper end thereof which extends downwardly with chamfered edges. The cruciform projection 33 extends into the crater-shaped depression of the screw cap closure.

The external diameter of the counting unit 11 in the region below the toothed ring is somewhat smaller than the inner diameter of the housing 10 so that the counting unit 11 is freely rotatable within the housing 10.

Figure 6:
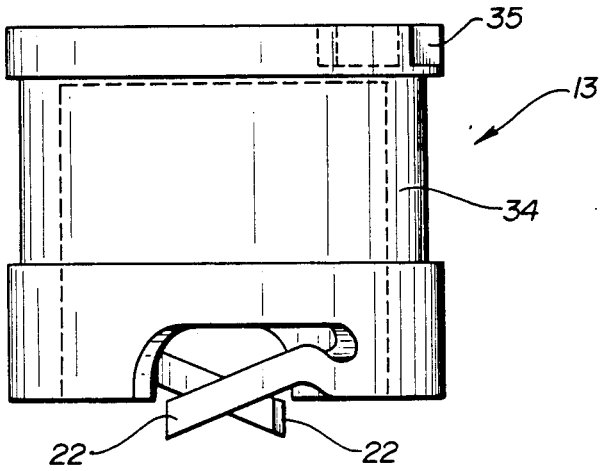
FIG. 6 shows a side view of the display unit.
Figure 7:
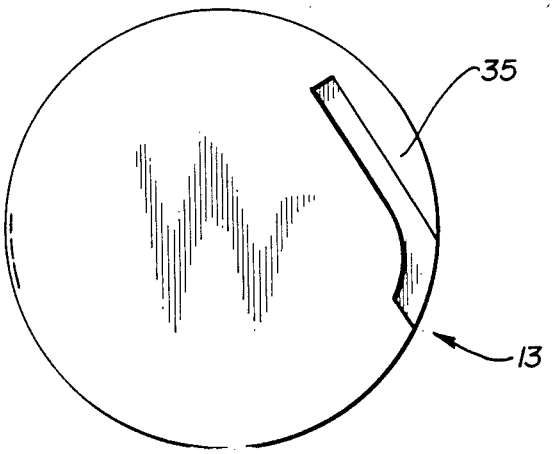
FIG. 7 shows a plan view of the display unit.

FIGS. 6 and 7 show the display unit 13. It is likewise shaped like an open-bottomed hollow cylinder. The external diameter of the display unit 13 is matched to the inner diameter of the housing 10 such that there is sliding fit between the two units, i.e. that the display unit 13, though being not freely movable within the housing 10, can be turned with only slight force within the housing 10. Spaced from the upper and lower ends the display unit 13 has a display region 34 of somewhat reduced outer diameter. Said region carries the display areas extending each over an angular width of 25.71° and bearing the indicia. In the present case these are the weekdays, each weekday appearing two consecutive times on differently colored areas. The reduction of the outer diameter in the display region 34 is to prevent the indicia from containing the inner side of the housing 10 and thus being chafed away. Two pawls 22 are provided at the lower rim of the display unit 13 in diametrically opposed relation forming, together with the teeth 21 of the counting unit 11, the ratchet 14. The pawls 22 resiliently extend beyond the lower rim of the display unit 13 so that they resiliently bear against the teeth 21. In the upper end wall of the display unit 13 a small spring 35 in the form of a stiff steel wire can be inserted, as shown in FIG. 7, urging against the inside of the housing 10 and making sliding fit of steady torque. The hollow inside of the display unit 13 has a somewhat larger inner diameter than the outer diameter in the upper region of the counting unit 11.

Figure 8:
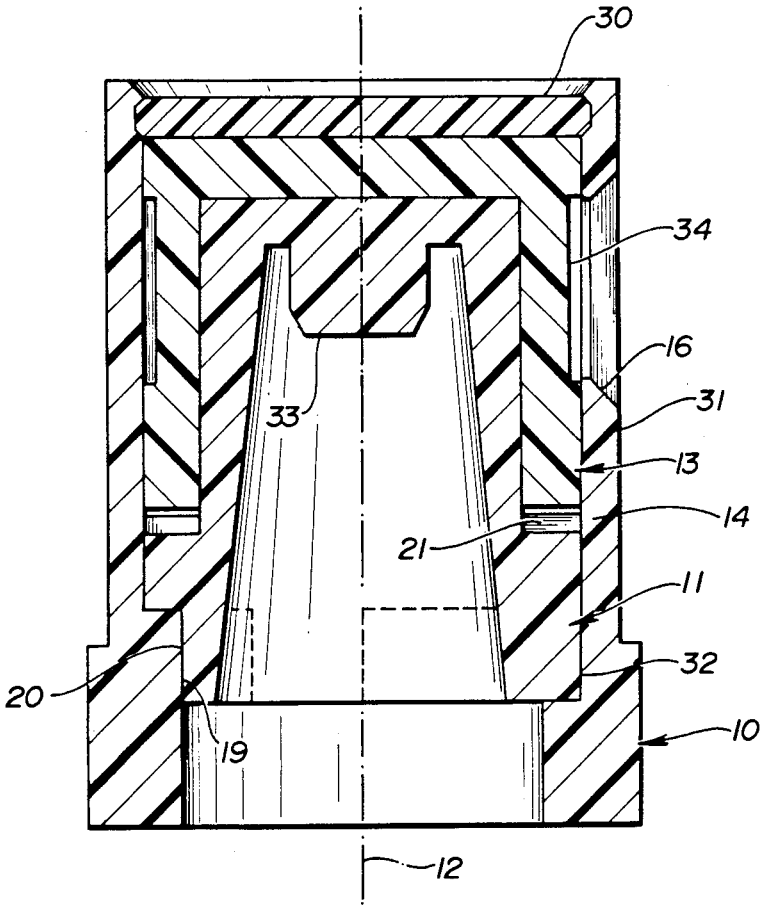
FIG. 8 shows the closure counter in assembled condition in a plane laid through the longitudinal axis.

FIG. 8 shows a section through the assembled closure counter. The closure counter is assembled such that the counting unit 11 is introduced into the housing 10 from above in such a way that the niche-like recesses 20 of the counting unit 11 receive the projections 19 in the housing 10.

The display unit 13 is then inserted into the annular space remaining between the counting unit 11 and the housing 10. The housing top is then closed by impression of the cover 30, whereafter the closure counter is complete and can be placed on the screw cap of a container.

The closure counter does not require any additional manipulation. Upon each opening and closing of the screw cap closure the next display area moves into the window 16 of the housing 10. Each time the rotary closure is opened and closed the counting unit 11 advances by 14th of a full rotation relative to the housing 10. Owing to the ratchet 14 the counting unit 11 takes along the display unit 13 only when rotated in one direction, namely when the screw cap closure is closed and the housing is turned clockwise while the counting unit 1 turns counterclockwise through a 14th of one full rotation relative to the housing thereby carrying along the display unit 13. When the housing is turned in the opposite direction, i.e. when the screw cap closure is opened, the counting unit rotates clockwise relative to the housing 10. Owing to the sliding fit between the display unit 13 and housing 10, the display unit corotates with the housing 10, and the pawls 22 slide over one tooth 21 and click behind said tooth 21. The number of teeth 21 is thus equal to the number of the display areas, and each tooth 21 extends through 25.71°, i.e. one 14th of a full circle, just like each display area.

The number of display areas, and thus also the number of teeth 21, can be selected according to requirements. Also the configuration of the hollow interior of the counting unit 11 can be adapted to the requirements of the individual case, i.e. to the external shape of the screw cap closure. The counting unit 11 itself can form the screw cap closure and, to this end, can be provided with threads in the lower portion of the interior cooperating with the external threads provided around the opening of the container to be closed. The housing 10, the counting unit 11, and the display unit 13 can be made of any desired material. Suitably they are injection molded from synthetic resin.

What is claimed is:

1. A closure counter for counting how many times a screw cap closure has been closed and opened, said closure counter being back in an initial position after N closing and opening operations, comprising:

an open-bottomed housing (10) having a longitudinal axis (12);

an open-bottomed cap-shaped counting unit (11) arranged in the housing (10) for rotation about the longitudinal axis (12) of the housing unit (10), said rotation relative to the housing (10) being limited to a fraction 1/N of one full rotation;

A display unit (13) arranged between the housing (10) and the counting unit (11) and arranged for rotation about the longitudinal axis (12) of the housing unit (10) relative to the counting unit (11), said rotation of the display unit (13) relative to the counting unit (11) being allowed by a ratchet (14) in only one direction, and being limited to 1/N of one full rotation;

and a sliding fit between the housing (10) and the display unit (13).

2. Closure counter according to claim 1, wherein the housing (10) is cylindrical, an external wall thereof has a window (16), and the display unit (13) is arranged between the housing (10) and the counting unit (11) so that a section of the display unit (13) is visible through the window (16).

3. Closure counter according to claim 1 or 2, wherein the limitation of the rotary motion of the counting unit (11) relative to the housing (10) is effected by projections (19) provided on an inside end of the open-bottom of the housing (10) for engagement with recesses (20) in an outside portion of the counting unit (11), that are larger than the projections (19) by the fraction 1/N of one full circle.

4. Closure counter according to claim 1, wherein the ratchet (14) consists of upwardly pointing sawtooth-shaped teeth (21) jutting out from a lower portion of the counting unit (11) on an outside portion thereof, and of at least one pawl (22) at a lower rim of the display unit (13).

5. Closure counter according to claim 1, wherein N is a number that is either seven or fourteen.

* * * * *